US008720477B1

(12) United States Patent
Al-Hasan

(10) Patent No.: US 8,720,477 B1
(45) Date of Patent: May 13, 2014

(54) DRAIN ASSEMBLY

(71) Applicant: Khaled Jafar Al-Hasan, Al-Zahra (KW)

(72) Inventor: Khaled Jafar Al-Hasan, Al-Zahra (KW)

( * ) Notice: Subject to any disclaimer, the term of this patent is extended or adjusted under 35 U.S.C. 154(b) by 0 days.

(21) Appl. No.: 14/101,275

(22) Filed: Dec. 9, 2013

(30) Foreign Application Priority Data

Dec. 11, 2012 (EP) ..... EP12196580

(51) Int. Cl.
*E03F 5/04* (2006.01)
*F16K 31/22* (2006.01)
*F16K 31/28* (2006.01)

(52) U.S. Cl.
USPC ..... 137/362; 137/397; 137/398; 137/423; 137/433

(58) Field of Classification Search
CPC ..... F16K 31/22; F16K 31/20; F16K 31/28; E03F 5/0407; E03F 5/0408; E03F 9/007
USPC ..... 137/362, 433, 397, 398, 386, 423
See application file for complete search history.

(56) References Cited

U.S. PATENT DOCUMENTS

| | | | | |
|---|---|---|---|---|
| 4,936,338 | A | 6/1990 | Fonoimoana | |
| 5,201,340 | A * | 4/1993 | Teepe | 137/315.18 |
| 5,208,921 | A | 5/1993 | Nicoll | |
| 5,915,408 | A * | 6/1999 | Dudley | 137/244 |
| 6,131,605 | A * | 10/2000 | Kothe et al. | 137/423 |
| 6,195,819 | B1 | 3/2001 | Wang | |
| 6,226,806 | B1 | 5/2001 | Ball | |
| 6,318,397 | B1 | 11/2001 | Huber et al. | |
| 6,886,588 | B2 * | 5/2005 | Malenfant et al. | 137/399 |
| 7,246,386 | B2 | 7/2007 | Hall | |
| 2010/0071122 | A1 | 3/2010 | Li | |

FOREIGN PATENT DOCUMENTS

| | | | |
|---|---|---|---|
| DE | 21 62 084 | A1 | 6/1973 |
| DE | 88 05 040 | U1 | 5/1988 |
| DE | 37 37 767 | A1 | 5/1989 |
| DE | 299 19 459 | U1 | 2/2000 |
| EP | 1 607 542 | A1 | 12/2005 |
| EP | 1 923 514 | A1 | 5/2008 |
| EP | 2 305 906 | A1 | 4/2011 |

* cited by examiner

*Primary Examiner* — Craig Schneider
(74) *Attorney, Agent, or Firm* — Richard C Litman

(57) ABSTRACT

A drain assembly includes a closing element having a lower surface and one or more floating elements extending from the lower surface. A receiver element has an inner ring and an outer ring and one or more receptacles disposed between the inner ring and outer ring. The receptacles receive corresponding floating elements and the receiver element has one or more inlet openings associated with the outer ring and one or more outlet openings associated with the inner ring. The one or more inlet openings receive a liquid to fill the receptacles to provide a lifting movement to the one or more floating elements within the corresponding one or more receptacles to lift the closing element. As the closing element lifts, the one or more receptacles fill with the liquid and drain the liquid from the one or more outlet openings.

20 Claims, 7 Drawing Sheets

DRAIN ASSEMBLY

CROSS-REFERENCE TO RELATED APPLICATION

This application claims the benefit of priority under 35 USC §119 of European Patent Office Application Serial No. EP 12196580, filed Dec. 11, 2012 in the European Patent Office, incorporated by reference herein in its entirety.

BACKGROUND OF THE INVENTION

1. Field of the Invention

The present invention relates to draining liquids, and particularly to a drain assembly.

2. Description of the Related Art

Drain assemblies are implemented in locations where quantities of liquid, for instance water, are used and where the liquid is taken from a supply. Present drain assemblies can have a base, a sump, a water inlet, a waste water outlet, a clamp element and a removable cap. Issues with present drain assemblies can occur when the water inlet or the cap of the drain assembly cannot be adjusted or, if they can be adjusted, need to be adjusted manually. This can allow for a limited flow of water, which is defined by the size of the water inlet, to be drained. If a large quantity of water needs to be drained, the limited drainage flow of water can be an issue which can lead to temporary flooding which can result in damages. Another possible issue with present drain assemblies is that they may not be resistant against vertical loads, such as can be caused when stepping on a drain assembly located in a floor, for example.

Thus, it is desirable that a drain assembly can drain a relatively large quantity of liquid by increasing its liquid flow, as well as being resistant to vertical loads.

Thus, a drain assembly addressing the aforementioned problems is desired.

SUMMARY OF THE INVENTION

Embodiments for a drain assembly are provided. The drain assembly includes a closing element having a lower surface and one or more floating elements extending from the lower surface of the closing element. The drain assembly further includes a receiver element having an inner ring and an outer ring and one or more receptacles disposed between the inner ring and the outer ring. The one or more receptacles can movably receive a corresponding one or more floating elements and the receiver element has one or more inlet openings associated with the outer ring and one or more outlet openings associated with the inner ring. The one or more inlet openings can receive a liquid to fill the one or more receptacles with the liquid to provide a lifting movement to the one or more floating elements that are within the corresponding one or more receptacles to lift the closing element. As the closing element is lifted the one or more receptacles fill with the liquid and are adapted to drain the liquid from the one or more outlet openings associated with the inner ring. Further embodiments of a drain assembly include the closing element having a central axis and the receiver element having a central axis.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
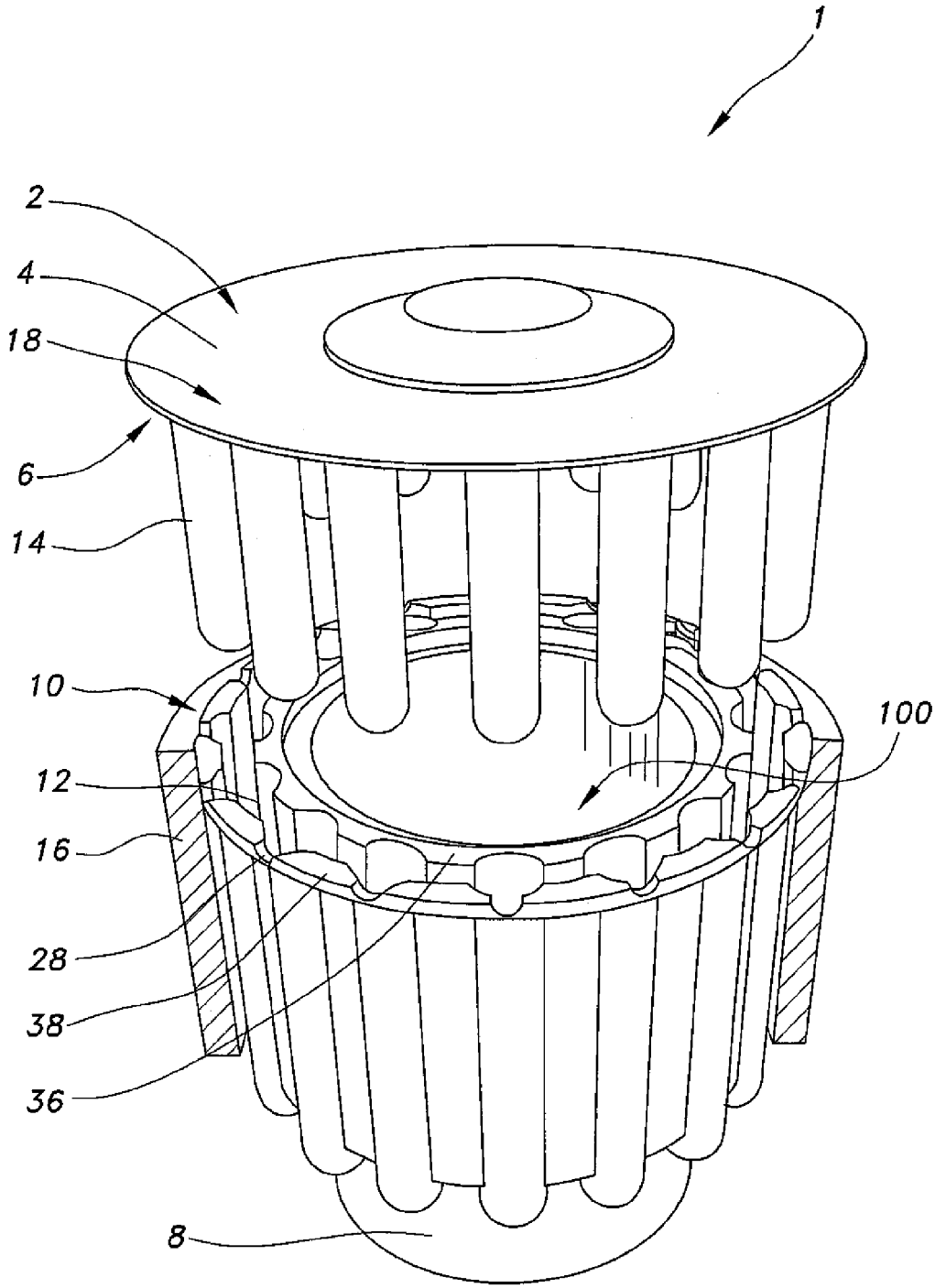
FIG. 1 is a partial exploded view of an embodiment of a drain assembly according to the present invention.
Figure 4:
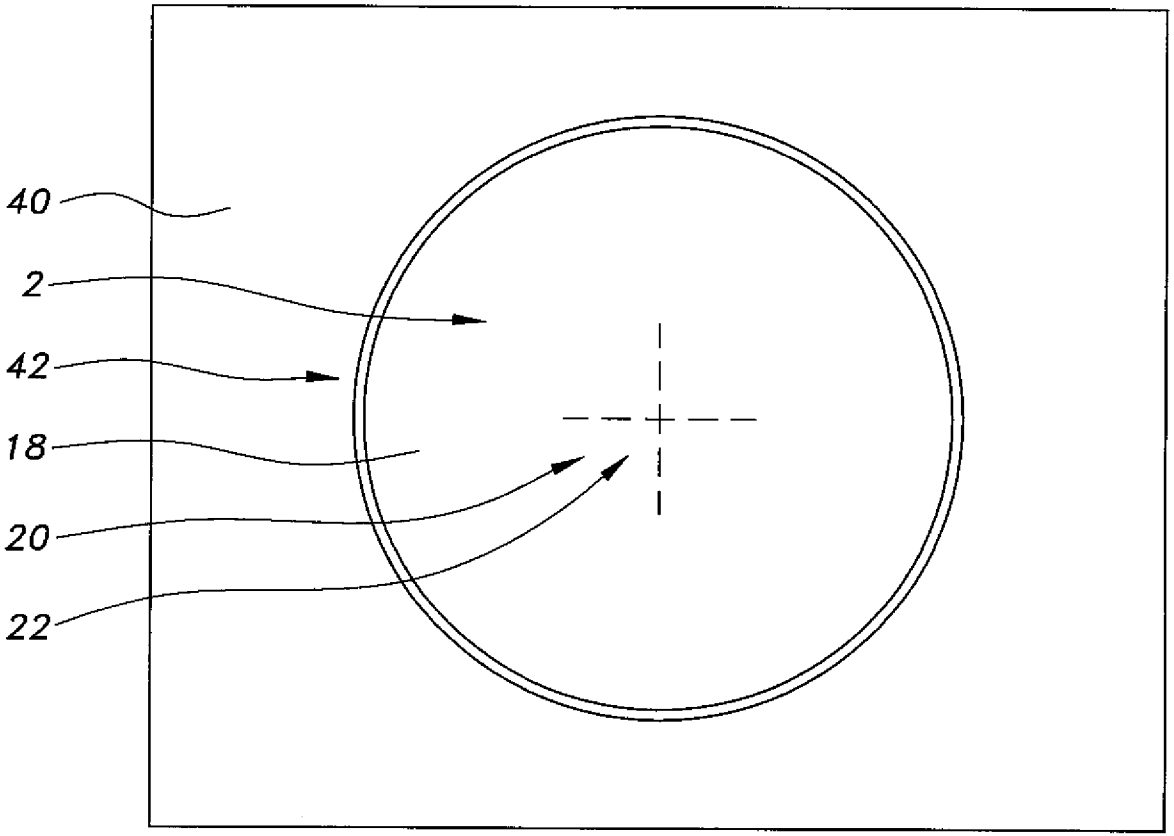
FIG. 4 is a top view of an embodiment of a drain assembly according to the present invention.
Figure 5:
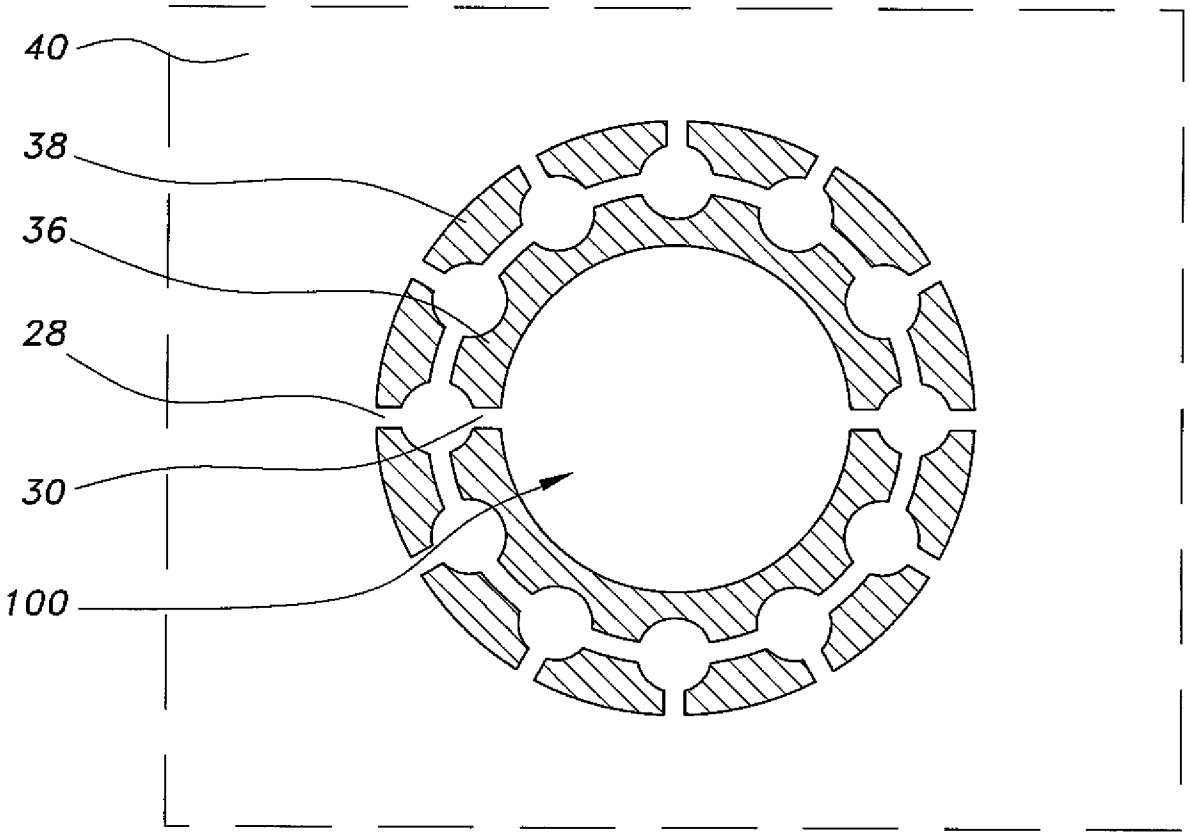
FIG. 5 is a top cross-sectional view of an embodiment of a receiver element of an embodiment of a drain assembly according to the present invention.
Figure 6:
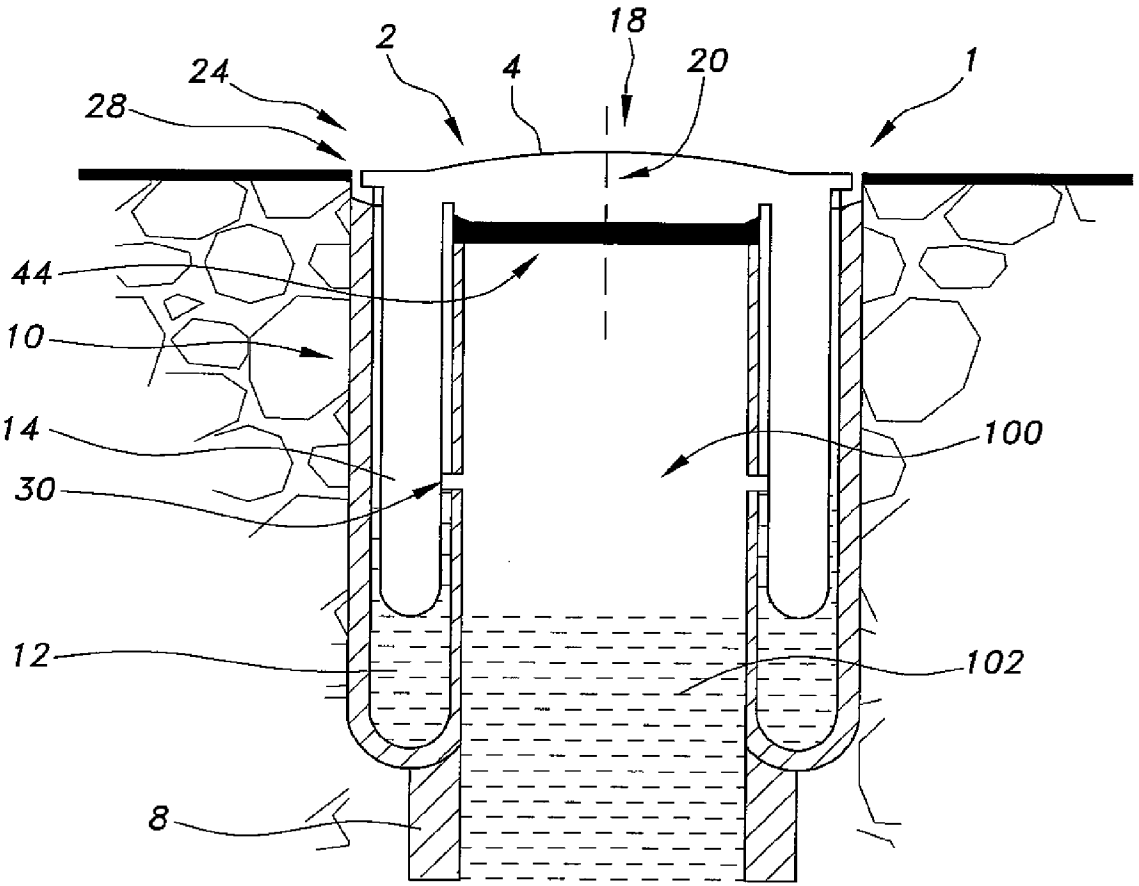
FIG. 6 is a sectional view of an embodiment of a drain assembly with a closing element in a first position according to the present invention.

Referring to FIGS. 1-7, an embodiment of a drain assembly, such as a drain assembly 1, is shown. The drain assembly 1 includes a closing element 2 that has an upper surface 4 and a lower surface 6 and, as shown in FIG. 6, the closing element 2 can also include a central axis 20. The closing element 2 further includes a cover plate 18, as shown in FIG. 1. The cover plate 18 of the closing element 2 can be of various shapes, and can have a small elevation on its upper surface, as shown in FIG. 1. For example, the cover plate 18 can be tabular shaped, and/or round shaped as shown in FIG. 1, or can also be square-shaped. Further, the shape of the cover plate 18 can also be adapted to correspond with the shape of a passage 100 of a receiver element 10, or the shape of the cover plate 18 can be adapted to correspond with the inner dimensions or outer dimensions of the receiver element 10. The closing element 2 and the receiver element 10 can be made from materials that are robust and durable in certain environments, such as in humid environments, and materials that can withstand contact with liquids, such as water, several times each day. Examples of such materials that the closing element 2 and the receiver element 10 can be made from include metals such as stainless steel or plastic materials like rigid plastics such as Polyvinyl Chloride (PVC).

Extending from the lower surface 6 of the closing element 2 is at least one and desirably a plurality of floating elements 14. The one or more floating elements 14 can be coupled to the closing element 2 by various securing mechanisms. For instance, the one or more floating elements 14 can be linked mechanically by a screw connection or by adhesion. Another possible example is that the closing element 2 and the one or more floating elements 14 are designed as a single part, such as by injection molding. The one or more floating elements 14 can be of different shapes, and can be formed, for example, as hollow or solid buoys, can be filled with various materials and can be made of different materials. Examples of shapes that the one or more floating elements 14 can be include cylindrical shapes as shown in FIG. 1, prismatic shapes, or spherical shapes. Further, the one or more floating elements 14 can be made from a material having a low density. Examples of materials having a low density include polystyrene or other similar low-density plastic materials.

The one or more floating elements 14 can be disposed around the central axis 20 of the closing element 2. For example, a plurality of the floating elements 14 can be circularly arranged around the central axis 20 of the closing element 2. Desirably, a plurality of the floating elements 14 can be arranged such that each of the plurality of floating elements 14 features a same distance and a same segment of a circle to the adjacent floating elements 14 on right and left sides thereof. The one or more floating elements 14 can be movably received by a corresponding at least one and desirably a plurality of receptacles 12 of the receiver element 10, and can be at least partially disposed or incorporated therein, with a pattern of the one or more floating elements 14 corresponding to or matching a pattern of the one or more receptacles 12. Further, a plurality of the floating elements 14 can also be arranged in a random-like order.

Figure 2:
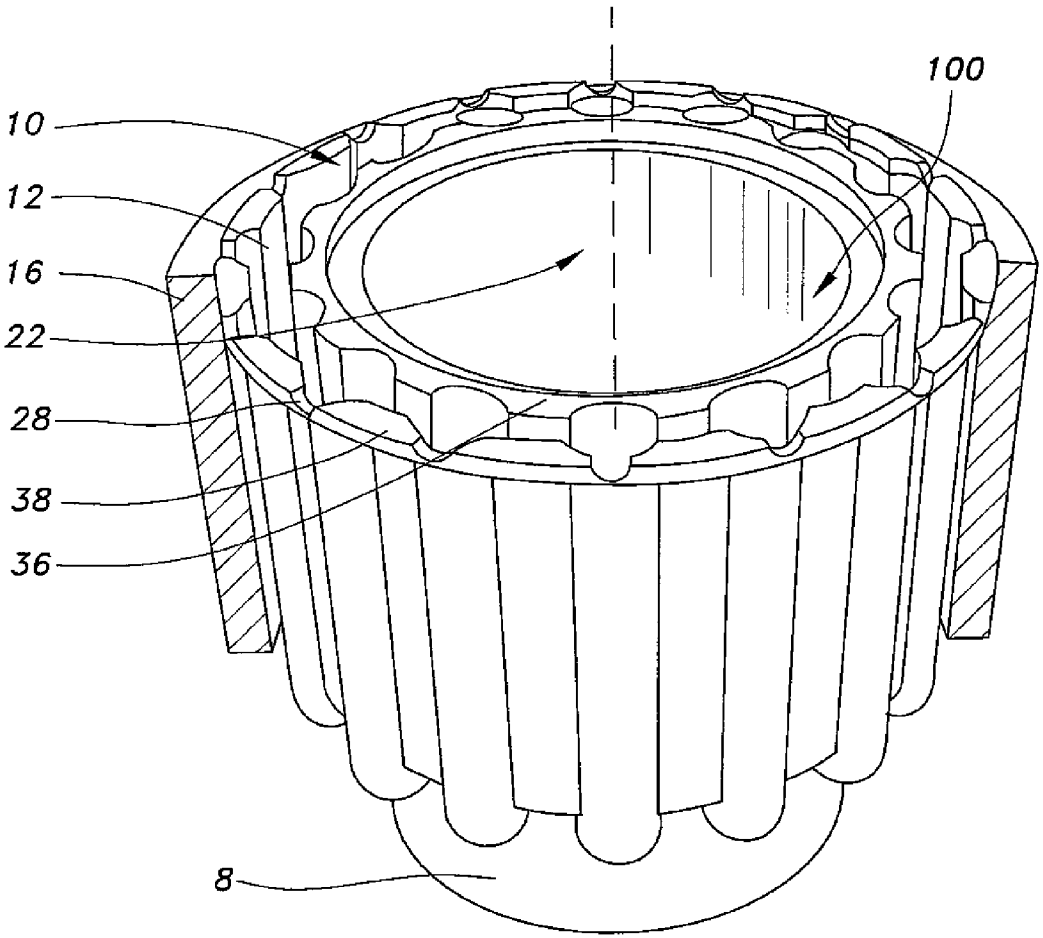
FIG. 2 is a partial sectional view of an embodiment of a receiver element of an embodiment of a drain assembly according to the present invention.

The one or more receptacles 12, as can be described as containers in which the liquid level therein can rise, can be disposed between an inner ring 36 and an outer ring 38 of the receiver element 10 and desirably can be cylindrically shaped. Also, the inner ring 36 and the outer ring 38 of the receiver element 10 can be coupled to each other. The receiver element 10 is surrounded by a housing 16. The inner diameter of the round shaped housing 16 roughly corresponds to the outer diameter of the round shaped outer ring 38. Further, a plurality of the receptacles 12 can also be disposed around a central axis 22 of the receiver element 10 and as can be circularly arranged around the central axis 22 of the receiver element 10, as shown in FIG. 2. The central axis 22 of the receiver element 10 can be aligned with the central axis 20 of the closing element 2. Further, the central axis 22 of the receiver element 10 can correspond with a central axis of a drain pipe 8 when the housing 16 of receiver element 10 is connected to the drain pipe 8, which directs a liquid 102 to be drained into sewerage or other sanitary system, and the closing element 2 can be at least partially disposed in the housing 16. Also, the housing 16 can be mechanically linked to the receiver element 10 and can have a rotational degree of freedom around a vertical axis, or both. Further, the housing 16 can be a non-separable or non-removable part of the receiver element 10. As shown in FIGS. 1, 2 and 5, at least a portion of a plurality of the receptacles 12 can be in fluid communication with one another.

Figure 7:
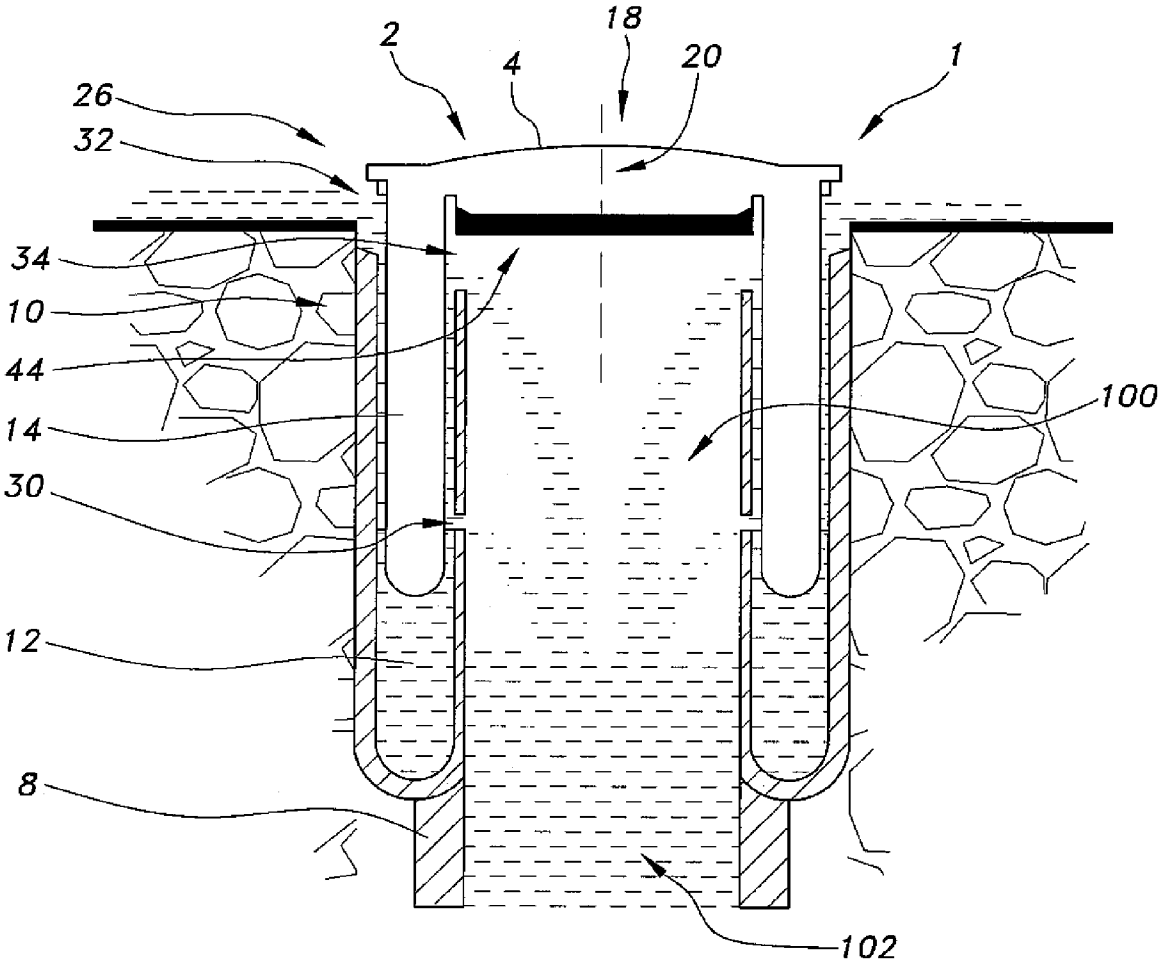
FIG. 7 is a sectional view of an embodiment of a drain assembly with a closing element in a second position according to the present invention.

One or more inlet openings 28 are associated with the outer ring 38 of the receiver element 10. The one or more inlet openings 28 can receive a liquid 102, such as water, such as illustrated in FIG. 7. As the one or more inlet openings 28 receive the liquid 102, the liquid can travel from the one or more inlet openings 28 into the one or more receptacles 12. As the liquid 102 enters the one or more receptacles 12, the liquid 102 can drain out of one or more outlet openings 30 associated with the inner ring 36 and into the passage 100 allowing the liquid 102 to flow through the receiver element 10. Also, the passage 100 of the receiver element 10 can be connected to some of a plurality of the receptacles 12 by the one or more outlet openings 30.

With the one or more inlet openings 28 disposed in the outer ring 38 and the one or more outlet openings 30 disposed in the inner ring 36, the one or more receptacles 12 can be therefore disposed between the inner ring 36 and the outer ring 38 of the receiver element 10. By having both one or more inlet openings 28 and one or more outlet openings 30 in the receiver element 10, small amounts of the liquid 102 can be drained while the closing element 2 is in an at least partially closed first position 24, as shown in FIG. 6. When the closing element 2 is in the first position 24, as shown in FIG. 6, the closing element 2 can be at least partially disposed in the housing 16 of the receiver element 10.

As the liquid 102 continues to fill into the one or more receptacles 12, the one or more floating elements 14 correspondingly positioned within the one or more receptacles 12 will begin to float or lift as the amount of the liquid 102 filling into the one or more receptacles 12 increases, as illustrated in FIG. 7. The increasing amount of liquid 102 in the one or more receptacles 12 leads to a lifting movement of the one or more floating elements 14, which is directly transferred to the closing element 2 as can increase a flow rate of the liquid 102 drained. As the one or more floating elements 14 lift, the closing element 2 moves from the at least partially closed first position 24, where the closing element 2 can be at least partially disposed in the housing 16 of the receiver element 10, and into a second position 26 of a lifted height from the housing 16 as the liquid level of the liquid 102 starts to increase within the one or more receptacles 12, as shown in FIG. 7.

As the closing element 2 is lifted into the second position 26, additional amounts of the liquid 102 can flow into one or more additional inlet openings 32 as can lead to an increased flow of the liquid 102 which can allow for additional amounts of the liquid 102 to be drained through one or more additional outlet openings 34, such as can be formed by gaps between two of a plurality of the floating elements 14. Also, each of the one or more additional inlet openings 32 can have a corresponding additional outlet opening 34 of the one or more additional outlet openings 34. Therefore, a size of the one or more additional inlet openings 32 and a size of the one or more additional outlet openings 34 can depend on the lifted height of the closing element 2 and on the arrangement of a plurality of the floating elements 14, as illustrated in FIG. 7. This self-adjusting mechanism, such as based on the buoyancy effect, can allow for controlling the flow of the liquid 102, such as without electrical or other means to control the flow, and can allow the flow of the liquid 102 to adapt itself to an amount of the liquid 102 drained. Also, the one or more inlet openings 28 and the one or more outlet openings 30, as well as the one or more additional inlet openings 32 and the one or more additional outlet openings 34, can be formed as slots and/or bores and/or holes.

The one or more additional inlet openings 32 are circularly positioned at peripheral edges of the closing element 2 and are arranged around the central axis 20 of the closing element 2. The lower surface 6 of the closing element 2 includes a protrusion 44 that is responsible for locking and releasing at least one of the one or more additional outlet openings 34. While the closing element 2 is in the first position 24, the one or more additional inlet openings 32 and the one or more additional outlet openings 34 are locked by the protrusion 44. When the closing element 2 is in the second position 26, the protrusion 44 is released which releases at least one of the one or more additional outlet openings 34, such as shown in FIG. 7.

Figure 3:
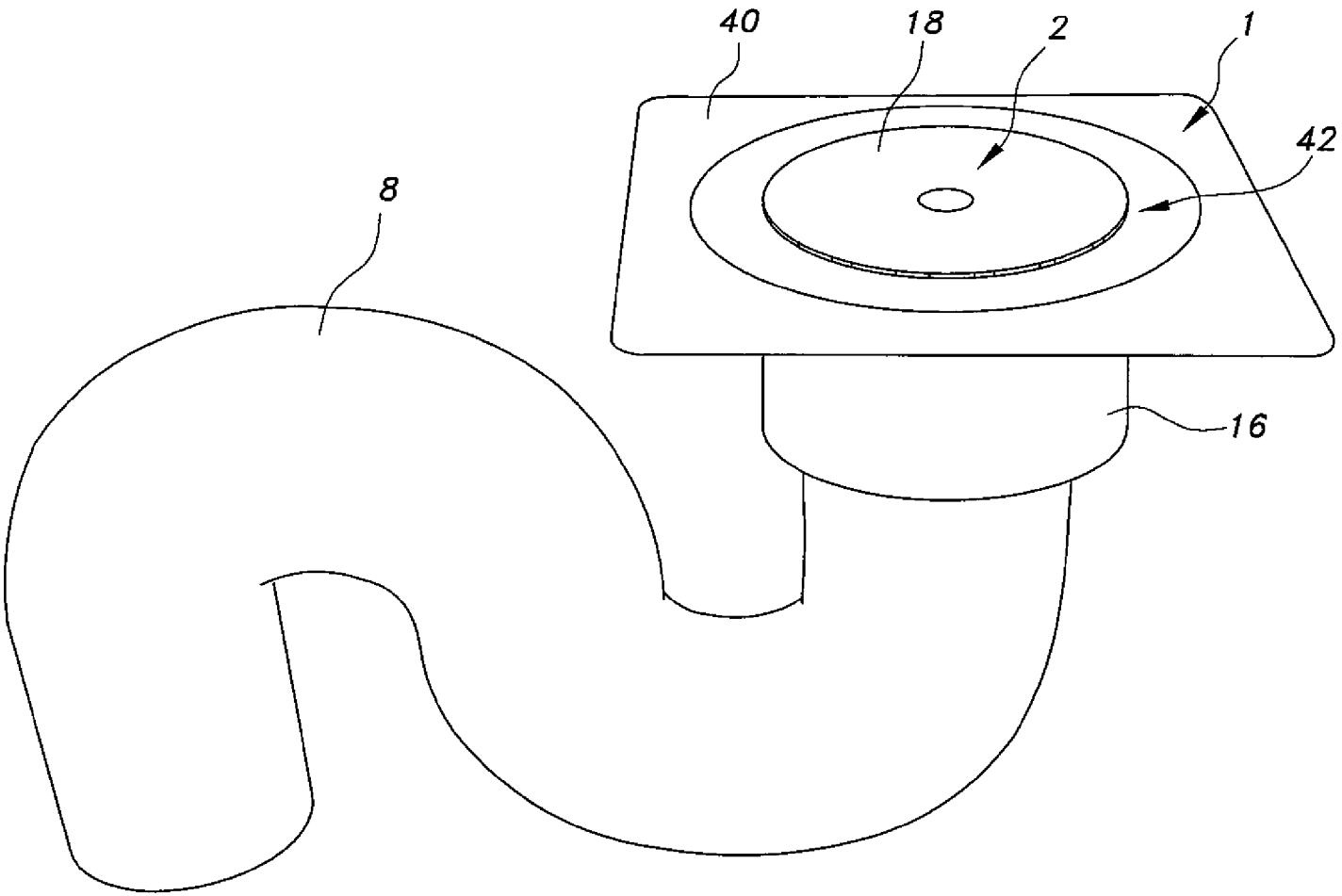
FIG. 3 is an environmental view of an embodiment of a drain assembly according to the present invention.

Referring to FIGS. 3-5, the drain assembly 1 is connected to the drain pipe 8 which can be at least partially covered by the closing element 2. A frame 40 can be used to position and/or install the drain assembly 1 on a floor and can provide a connection between a floor and the receiver element 10, as well as can also be a decorative element. The cover plate 18 of the closing element 2 is disposed in an opening 42 of the frame 40. The opening 42 of the frame 40, as desirably placed in the middle of the frame 40, can correspond to the dimensions and the shape of the closing element 2. The frame 40, as can also be termed a flange, can be square shaped or circular-shaped and have a tabular body, which outwardly extends from the closing element 2. The upper surface 4 of the closing element 2 can be disposed in the same horizontal plane as an upper surface of the frame 40, such as when the closing element 2 is in the first position 24, or can be in the same horizontal plane as a floor in which the drain assembly 1 is installed, such as at the peripheral edges of the cover plate 18.

As shown in FIGS. 3 and 6, the closing element 2 is in the first position 24 and is not affected by any buoyancy or lifting forces and lies, as a consequence of gravity, with its lower surface 6 on an upper edge of the receiver element 10. Since the receiver element 10 includes one or more inlet openings 28 and one or more outlet openings 30, small amounts of the liquid 102, such as water, can also be drained while the closing element 2 is in the first position 24, such that a continuous drainage of the liquid 102 can be possible when the closing element 2 is in the first position 24. Such continuous drainage can be realized by at least one of the one or more inlet openings 28 and at least one of the one or more outlet openings 30 of the receiver element 10 which can allow the liquid 102 to travel from outside of the drain assembly 1 through the passage 100 of the receiver element 10 out of the drain assembly 1. Therefore, it typically is not necessary to lift the closing element 2 of the drain assembly 1 in order to drain small quantities of the liquid 102, such as water. Also, the one or more inlet openings 28 and the one or more outlet openings 30 can have a direct connection to the passage 100 of the receiver element 10.

The closing element 2 is disposed in the opening 42 of the frame 40, which is positioned in the middle of the frame 40. As shown in FIG. 4, the outer diameter of the cover plate 18 of the closing element 2 can be smaller than the inner diameter of the opening 42 in the middle of the frame 40. The different diameters can result in a circular gap between the cover plate 18 and an inner edge of the frame 40. The liquid 102, such as water, can enter the drain assembly 1 through this circular gap. The gap directs the entering liquid 102 to the one or more inlet openings 28 of the receiver element 10. Also, the one or more inlet openings 28 can be greater than a number of the one or more outlet openings 30 as, for example, shown in FIG. 5. This unbalanced relation between the number of the one or more inlet openings 28 and the number of the one or more outlet openings 30 can continuously increase the level liquid height within the plurality of receptacles 12 to force the plurality of floating elements 14 and the closing element 2 to lift while the liquid 102 enters the drain assembly 1.

It is to be understood that the present invention is not limited to the embodiments described above, but encompasses any and all embodiments within the scope of the following claims.

I claim:

1. A drain assembly, comprising:

a closing element, the closing element having a lower surface;

one or more floating elements extending from the lower surface of the closing element; and a receiver element having an inner ring and an outer ring, the receiver element having one or more receptacles disposed between the inner ring and the outer ring of the receiver element to movably receive corresponding one or more floating elements, and the receiver element having one or more inlet openings associated with the outer ring and one or more outlet openings associated with the inner ring, wherein the one or more inlet openings associated with the outer ring are adapted to receive a liquid, the liquid filling the one or more receptacles to provide a lifting movement to the one or more floating elements within the corresponding one or more receptacles to lift the closing element to fill the one or more receptacles with the liquid and the one or more outlet openings associated with the inner ring are adapted to drain the liquid from the one or more receptacles.

2. The drain assembly according to claim 1, wherein the one or more receptacles comprise a plurality of receptacles and at least a portion of the plurality of receptacles are in fluid communication with one another.

3. The drain assembly according to claim 1, wherein the closing element comprises a cover plate of a shape selected from the group consisting of a tabular shape, a round shape and a square-shape.

4. The drain assembly according to claim 1, wherein the receiver element is adapted to communicate with a drain pipe to drain the liquid.

5. The drain assembly according to claim 1, wherein the liquid comprises water.

6. The drain assembly according to claim 1, wherein the one or more floating elements comprise a shape selected from the group consisting of a cylindrical shape, a prismatic shape and a spherical shape.

7. The drain assembly according to claim 1, wherein the one or more receptacles comprise a plurality of receptacles and at least a portion of said plurality of receptacles are in fluid communication with one another.

8. The drain assembly according to claim 1, wherein the receiver element further comprises:

one or more additional inlet openings; and one or more additional outlet openings, wherein the one or more floating elements are adapted to move by the received liquid the closing element from an at least partially closed first position into a second position to allow the liquid to flow through the one or more additional inlet openings and the one or more additional outlet openings to a passage of the receiver element to drain the received liquid.

9. The drain assembly according to claim 1, wherein a pattern of the one or more floating elements corresponds to a pattern of the one or more receptacles.

10. The drain assembly according to claim 1, wherein at least one of the closing element or the receiver element comprise a metal or a plastic material.

11. The drain assembly according to claim 10, wherein the one or more floating elements comprise a material of a low density.

12. The drain assembly according to claim 11, wherein the material of a low density comprises a low density plastic material.

13. The drain assembly according to claim 12, wherein the low density plastic material comprises polystyrene.

14. The drain assembly according to claim 10, wherein the metal or plastic material comprises a material selected from the group consisting of stainless steel, Polyvinyl Chloride (PVC) and other rigid plastics.

15. A drain assembly, comprising:

a closing element, the closing element having a lower surface and a central axis;

a plurality of floating elements extending from the lower surface of the closing element, the plurality of floating elements disposed around the central axis of the closing element; and a receiver element having a central axis aligned with the central axis of the closing element, the receiver element having an inner ring and an outer ring and a passage to allow liquid to flow through the receiver element to drain the liquid, and having a plurality of receptacles disposed between the inner ring and the outer ring of the receiver element and disposed around the central axis of the receiver element to movably receive corresponding floating elements, and having one or more inlet openings associated with the outer ring and one or more outlet openings associated with the inner ring, wherein the one or more inlet openings associated with the outer ring are adapted to receive the liquid, the liquid filling the plurality of receptacles to provide a lifting movement to the floating elements within the corresponding plurality of receptacles to lift the closing element to fill the plurality of receptacles with the liquid and the one or more outlet openings associated with the inner ring are adapted to drain the liquid from the plurality of receptacles into the passage of the receiver element.

16. The drain assembly according to claim 15, wherein the plurality of floating elements are circularly arranged around the central axis of the closing element.

17. The drain assembly according to claim 15, wherein the receiver element further comprises:

one or more additional inlet openings; and one or more additional outlet openings, wherein the plurality of floating elements are adapted to move by the received liquid the closing element from an at least partially closed first position into a second position to allow the liquid to flow through the one or more additional inlet openings and the one or more additional outlet openings to the passage of the receiver element to drain the liquid.

18. The drain assembly according to claim 17, wherein the receiver element is adapted for continuous drainage of the received liquid when the closing element is in the first position, the received liquid flowing through at least one inlet opening of the one or more inlet openings and at least one outlet opening of the one or more outlet openings of the receiver element.

19. The drain assembly according to claim 15, wherein a pattern of the plurality of floating elements corresponds to a pattern of the plurality of receptacles.

20. The drain assembly according to claim 15, wherein at least a portion of the plurality of receptacles are in fluid communication with one another.

* * * * *